US005759636A

United States Patent [19]

Taylor et al.

[11] Patent Number: 5,759,636

[45] Date of Patent: Jun. 2, 1998

[54] ELECTROGRAPHIC IMAGING ELEMENT

[75] Inventors: Dene Harvey Taylor, New Hope, Pa.; Everett Wyman Bennett, Easthampton, Mass.; Richard Scott Himmelwright, Wilbraham, Mass.; Douglas Allan Cahill, Belchertown, Mass.; Weitong Shi, Glastonbury, Conn.

[73] Assignee: Rexam Graphics, Inc., South Hadley, Mass.

[21] Appl. No.: 768,967

[22] Filed: Dec. 18, 1996

[51] Int. Cl.[6] ..... B05D 3/06

[52] U.S. Cl. ..... 427/498; 427/501; 427/513; 427/517; 427/411; 427/412; 427/412.1; 430/32; 430/56; 430/57; 430/96; 430/135

[58] Field of Search ..... 427/407.1, 411, 427/412, 412.1, 508, 512, 513, 517, 498, 501; 430/32, 56, 57, 96, 135

[56] References Cited

U.S. PATENT DOCUMENTS

| | | | |
|---|---|---|---|
| 3,486,932 | 12/1969 | Schaper et al. | 117/201 |
| 4,322,331 | 3/1982 | Shay | 524/815 |
| 4,420,541 | 12/1983 | Shay | 428/523 |
| 4,524,087 | 6/1985 | Engel | 427/2 |
| 4,830,939 | 5/1989 | Lee et al. | 429/192 |
| 4,981,729 | 1/1991 | Zaleski | 427/393.5 |
| 5,035,849 | 7/1991 | Uemura et al. | 264/255 |
| 5,192,613 | 3/1993 | Work, III et al. | 428/363 |
| 5,262,259 | 11/1993 | Chou et al. | 430/42 |
| 5,385,771 | 1/1995 | Willetts et al. | 428/211 |
| 5,399,413 | 3/1995 | Katsen et al. | 428/193 |
| 5,400,126 | 3/1995 | Cahill et al. | 355/277 |
| 5,414,502 | 5/1995 | Cahill et al. | 355/278 |
| 5,483,321 | 1/1996 | Cahill et al. | 355/200 |
| 5,486,421 | 1/1996 | Kobayashi | 428/421 |
| 5,621,057 | 4/1997 | Herzig et al. | 526/248 |

FOREIGN PATENT DOCUMENTS

| | | |
|---|---|---|
| 4001214 | 1/1992 | Japan . |

*Primary Examiner*—Erma Cameron
*Attorney, Agent, or Firm*—Ratner & Prestia

[57] ABSTRACT

A method for forming electrographic imaging elements comprising a uniform dielectric layer is disclosed. The method comprises coating a conductive coating composition containing polymerizable precursors onto a base, curing the composition to form a conductive layer, and coating a dielectric layer on top of the conductive layer. The elements can be used to produce images have higher image density, reduced background, reduced grain, reduced mottle, reduced overtoning, and greater small-scale uniformity than comparable images formed on electrographic imaging elements produced by other methods. The elements are particularly useful for forming large size colored images, such as are required for posters, displays, other indoor advertising.

22 Claims, 1 Drawing Sheet

ELECTROGRAPHIC IMAGING ELEMENT

FIELD OF THE INVENTION

This invention relates to elements for electrographic imaging. More particularly, this invention relates to a method for forming an electrographic imaging element comprising a uniform dielectric layer.

BACKGROUND OF THE INVENTION

Electrographic imaging elements, also known as electrographic recording elements and electrographic recording materials, comprise a conductive base and a dielectric coating. In use, a latent image is formed by the imagewise deposition of electrical charge onto the surface of the dialectic coating. Typically, charged styli, arranged in linear arrays across the width of a moving dielectric surface, are used to create the latent image. Such processes are disclosed, for example, in Helmberger, U.S. Pat. No. 4,007,489; Doggett, U.S. Pat. No. 4,731,542; and St. John, U.S. Pat. No. 4,569,584.

To render the latent image visible, toner particles that are attracted to the charge, normally in the form of a dry powder or a non-aqueous dispersion, are applied to the surface of the dielectric coating. The image is fixed by fusing the toner particles to the surface of the coating. Alternatively, the image of toner particles may be transferred to a receptor.

The element is normally formed by coating a conductive coating composition onto a base to form a conductive layer and overcoating the conductive layer with the dielectric layer. The conductive layer must (1) have electrical properties appropriate to the element, typically a surface resistivity of $10^5$–$10^8$ Ω/□, preferably $10^6$–$10^7$ Ω/□; (2) have a smooth surface; and (3) prevent the dielectric material from penetrating the base when the dielectric layer is coated on top of the conductive layer.

The conductive layer should have a smooth surface so that a uniform, continuous, and flaw-free dielectric layer is produced. If the dielectric layer is not uniform, a variety of problems that affect image quality can occur.

The charge applied by the stylus is related to the capacitance of the dielectric layer. If the layer is thick, the capacitance is low, so that the applied charge is low, producing toned areas with low image density. If the layer is thin, but not so thin that it breaks down, it has high capacitance. It can accept a high charge, producing toned areas with high image density. Thus, variations in the smoothness of the surface of the conductive layer causes differences in the thickness of the dielectric layer, which produce variations in image density. On paper, when the image density variation is of the scale of the fibers from the furnish or the threads in the fabrics of the paper-making machine, the variations are called "grain." When the variations are on the scale of the fiber floc, they are called "mottle."

An additional problem, known as overtoning, is observed in multi-colored images, which are produced by sequentially repeating the charging, toning, and fixing steps with different colored toners. In areas in which the dielectric layer is thin, the charge may be greater than can be satisfied by the toner. The residual charge that remains after the charging and fixing steps will attract toner particles during the subsequent toning step to produce a color shift. In the conventional charging and toning sequence KCMY (black, cyan, magenta, yellow), residual charge from the charging and toning sequence for black takes up cyan toner producing a blue tint in the black areas. The cyan areas are tinted mauve with magenta overtoning, and magenta is tinted red with yellow overtoning. Thus, purity of color is lost.

If the dielectric layer is not uniform, continuous, and flaw-free, dielectric breakdown at thin spots can occur during imaging. When dielectric breakdown occurs, the applied charge is lost. White untoned spots appear in the image.

In addition, the conductive layer must prevent the dielectric material from penetrating the base when the dielectric layer is coated on top of the conductive layer. If the dielectric material penetrates the base, the image will have poor density and unacceptable grain and mottle.

Therefore, in electrographic imaging, there is a need for conductive layers that have electrical properties appropriate for the imaging element; that are smooth so that a continuous, uniform, and flaw-free dielectric layer is produced; and that prevent the dielectric layer from penetrating the base during coating of the dielectric layer.

SUMMARY OF THE INVENTION

In one embodiment, the invention is a method for forming an electrographic imaging element, said element comprising, in order, a porous base, an electrically conductive layer, and a dielectric layer; said porous base and said electrically conductive layer each having a surface roughness, said electrically conductive layer having a surface resistivity, and said porous base having a solvent holdout; said method comprising, in order:

(A) forming said electrically conductive layer by:

(1) coating a conductive coating composition onto said porous base, said coating composition comprising:

(a) one or more ethylenically unsaturated ammonium precursors; and (b) one or more other polymerizable precursors; and (2) curing said conductive coating composition to form an intermediate element comprising said porous base and an electrically conductive layer, said intermediate element having a solvent holdout;

whereby:

the surface roughness of said electrically conductive layer is less than the surface roughness of said porous base;

the solvent holdout of said intermediate element is greater than the solvent holdout of said porous base; and said surface resistivity of said electrically conductive layer is $1\times10^5$ to $1\times10^8$ Ω/□; and (B) coating said dielectric layer onto said electrically conductive layer;

wherein:

said conductive coating composition comprises at least 50 percent total solids;

said conductive coating composition comprises 10 to 90 parts by weight of said one or more ethylenically unsaturated ammonium precursors and 10 to 90 parts by weight of said other polymerizable precursors, said parts by weight based on the total weight of said one or more ethylenically unsaturated ammonium precursors and said other polymerizable precursors present in said conductive coating composition; and said one or more ethylenically unsaturated ammonium precursors and said other polymerizable precursors together comprise at least 50 percent by weight of the total solids present in said conductive coating composition.

In a preferred embodiment the conductive coating composition comprises more than 70% total solids.

In a preferred embodiment the conductive coating composition comprises more than 40 parts by weight of the ethylenically unsaturated ammonium precursors. In a more preferred embodiment the conductive coating composition comprises more than 60 parts by weight, typically 60 to 80 parts by weight, of the ethylenically unsaturated ammonium precursors.

A conductive layer produced on a porous base by this method typically has Sheffield surface roughness that is less than the surface roughness of the porous base (measured on the side of the base over which the conductive layer is coated) by at least a factor of one third. Typically, Sheffield surface roughness values of less than about 70, more typically less than 40, are observed for conductive layers produced by this method on porous bases. Values of 30 to 15, and even 20 or less, are often observed.

Solvent holdout for the intermediate element formed by coating the conductive coating composition onto the porous base and curing it, measured on the coated side of the intermediate element, i.e., the side containing the conductive layer, is typically increased by at least factor of five and is frequently increased by a factor of at least 50 to 100. Solvent holdout for the intermediate element, measured on the coated side, is typically greater than 10 seconds, and is frequently greater 100 sec.

Because this method produces a conductive layer that is both smooth and resists penetration by solvent during coating of the dielectric layer, the images have higher image density, reduced background, reduced grain, reduced mottle, reduced overtoning, and greater small-scale uniformity than comparable images formed on electrographic imaging elements produced by other methods.

Because the conductive layer is more uniform, the operating voltage of the printer can be increased without causing dielectric breakdown. This provides more latitude to adjust color.

The electrographic imaging elements can be processed at higher speeds by printers using high solids liquid toners, increasing the productivity of the printer and reducing the time required to form an image. Background is caused by excess toner that is not removed by the printer. This need to remove excess toner limits the speed at which the printer can operate. Because smoothness prevents excess toner from being picked up in non-image areas during toning, electrographic imaging elements produced by this method have inherently lower background. Thus, higher solids toners can be used so that the printer can operate at higher speed without producing an unacceptably high background.

DETAILED DESCRIPTION OF THE INVENTION

Figure 1:
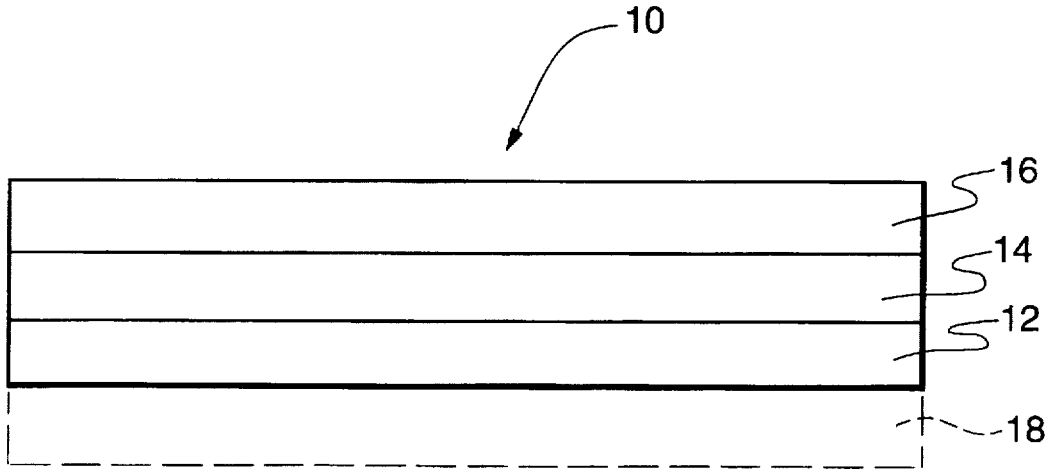
FIG. 1 represents an electrographic imaging element produced by the method of this invention.

In one embodiment, the invention is an element suitable for use in an electrographic imaging process. Referring to FIG. 1, electrographic imaging element 10 comprises base 12, conductive layer 14, and dielectric layer 16. Element 10 may also comprise backside conductive layer 18.

In another embodiment, the invention is method a for producing electrographic imaging element 10. The method comprises coating base 12 with a conductive coating composition that comprises at least 50 percent total solids; curing the layer thus formed to form conductive layer 14; and coating dielectric layer 16 on top of conductive layer 14.

CONDUCTIVE LAYER

Conductive Coating Composition

The conductive coating composition used to form conductive layer 14 comprises at least 50 percent total solids, and preferably at least 70 percent total solids, more preferably at least 73 percent total solids. If it is not necessary to add a small amount of volatile solvent to control the surface tension and viscosity of the conductive coating composition, at least 80 percent total solids is preferred.

Total solids refers to the total amount of non-volatile material in the conductive coating composition, even though some of these materials may be non-volatile liquids before cure. Preferably the conductive coating composition is a mixture of solid polymerizable precursors, non-volatile liquid polymerizable precursors, and other solid and/or non-volatile liquid materials, such as photoinitiators and pigments. If necessary, small amounts of volatile solvents may be added to control the viscosity and surface tension of the coating composition.

Conductive layer 14 typically has a thickness about 1 micron to about 20 microns. In a typical electrographic imaging element the conductive layer has surface resistivity of $10^5$–$10^8$ ohm/□, preferably $10^6$–$10^7$ ohm/□.

Ethylenically Unsaturated Ammonium Precursors

The conductive layer is rendered conductive by one or more ethylenically unsaturated ammonium precursors. Ethylenically unsaturated ammonium precursor means a polymerizable, ethylenically unsaturated, quaternary ammonium salt that contains an ammonium cation and an inorganic or organic anion. These precursors undergo free radical initiated addition polymerization with themselves and with other polymerizable precursors to form the conductive layer.

Ethylenically unsaturated ammonium precursor typically have the following structures:

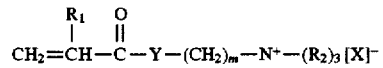

I

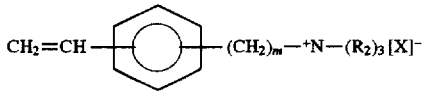

II

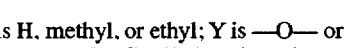

III in which $R_1$ is H, methyl, or ethyl; Y is —O— or —($NR_3$)— wherein $R_3$ is H or a $C_1$–$C_4$ alkyl; m is an integer from 1 to 4, each $R_2$ individually is a $C_1$–$C_4$ alkyl group; and $[X]^-$ is an anion.

Typical cations are (3-(methacryloylamino)-propyl)-trimethylammonium, (2-(methacryloyloxy)-ethyl) trimethylammonium, (2-(acryloyloxy)ethyl) trimethylammonium, (2-(methacryloyloxy)ethyl)-methyldiethylammonium, 4-vinylbenzyltrimethylammonium, and dimethyldiallylammonium. The anion may be any inorganic or organic anion conventionally used in such quaternary salts such as chloride, methosulfate, nitrate, and the like.

Representative ethylenically unsaturated ammonium precursors include (3-(methacryloylamino)propyl) trimethylammonium chloride (MAPTAC), 2-methacryloyloxyethyltrimethylammonium methylsulfate (Ageflex® FM1Q80DMS), 2-acryloyloxyethyltrimethylammonium chloride (Ageflex®

FA1Q80MC), 2-methacryloyloxyethyltrimethylammonium chloride (Ageflex® FM1Q75MC), 2-acryloyloxyethyltrimethylammonium methylsulfate (Ageflex® FA1Q80DMS), 2-acryloyloxyethyldiethylammonium methylsulfate (Ageflex® FA2Q80DMS), dimethyldiallylammonium chloride (Ageflex® DMDAC), and vinylbenzyltrimethylammonium chloride. Because has been observed that the conductivity of the coating is determined largely, but not wholly, by the molal concentration (moles/Kg, all densities being close to unity) of quaternary salt present, the more preferred salts are generally those with the lowest molecular weights.

Ethylenically unsaturated ammonium precursors are water soluble and are typically supplied as a mixture that contains up to 50 weight percent, generally about 20 to 40 weight percent, water. If the water content of the mixture does not exceed about 50 percent by weight, it is unnecessary to remove the water before the mixture is used to form the conductive coating. Because conductivity depends on the presence of water in the conductive coating, the coating typically comprises about 10 to 20 weight percent water. However, the water present in the monomer is not included in the calculation of total solids.

Other Polymerizable Precursors

The conductive coating composition comprises one or more other polymerizable precursors. Other polymerizable precursors includes ethylenically unsaturated materials other than the ethylenically unsaturated ammonium precursors that undergo free radical initiated addition polymerization. Both monofunctional polymerizable precursors and polyfunctional polymerizable precursors are included. Such precursors are discussed in, for example, Chemistry and Technology of UV and EB Formulation for Coatings, Inks, and Paints, P. K. T. Oldring, ed, SITA Technology Ltd., London, 1991, Vol. 2.

Polyfunctional precursors have two or more ethylenically unsaturated functional groups capable of free-radical addition polymerization. These precursors may be either polyfunctional monomers or polyfunctional oligomeric materials. Polyfunctional precursors are cross-linking agents that accelerate growth of the polymer matrix during polymerization. Typical polyfunctional precursors include: trimethylolpropane triacrylate, trimethylolpropane trimethacrylate, pentaerythritol triacrylate, pentaerythritol tetraacrylate, pentaerythritol tetramethacrylate, ethoxylated-trimethylolpropane triacrylate, glycerolpropoxy triacrylate, ethyleneglycol diacrylate, tripropyleneglycol diacrylate, and tetraethyleneglycol diacrylate. Particularly useful are the ethoxylated precursors, such as ethoxylated-trimethylolpropane triacrylate (TMPEOTA). Polyfunctional oligomers may be used both to cross-link the conductive layer and to increase the viscosity of the conductive coating composition.

Monofunctional precursors contain one polymerizable group and are typically low viscosity liquids. They adjust the properties of the polymer, e.g., flexibility and glass transition temperature; adjust the viscosity of the conductive coating composition; and act a polymerizable cosolvent for the components of the conductive coating composition. Useful monofunctional precursors include, for example: N-vinyl pyrrolidone, tetrahydrofurfuryl acrylate (SR 285), tetrahydrofurfuryl methacrylate (SR 203), and 2-(2-ethoxyethoxy) ethyl acrylate (SR 256).

Conductivity Exalting Comonomers

The conductivity of the conductive layer may be enhanced by addition of one or more conductivity exalting comonomers. These comonomers are a special class of other polymerizable precursors. Conductivity exalting comonomers include (1) interpolymerizable acids with an acid number between 100 and 900, (2) hydroxyalkyl esters of acrylic or methacrylic acid, and (3) cyanoalkyl esters of acrylic or methacrylic acid. A single comonomer may be present in the material, or a mixture of comonomers may be present to provide the desired resistivity.

Typical interpolymerizable acids that may be used to enhance electrical conductivity include acrylic acid, methacrylic acid, β-carboxyethyl acrylate, itaconic acid, 2-(acryloyloxy)ethyl maleate, 2-(methacryloyloxy)ethyl maleate, 2-(acryloyloxy)propyl maleate, 2-(methacryloyloxy)propyl maleate, 2-(acryloyloxy)ethyl succinate, 2-(methacryloyloxy)ethyl succinate, 2-(acryloyloxy)-ethyl o-phthalate, 2-(methacryloyloxy) ethyl o-phthalate, 1-carboxy-2-[2-acryloxyloxyethylcarboxylate]cyclohex-4-ene, 1-carboxy-2-[2-methacryloxyloxyethylcarboxylate]cyclohex-4-ene; and carboxylated additives having acid numbers of 100 to 900, such as Ebecryl® 169 and Ebecryl® 170. As is well known to those skilled in the art, acid number is defined as the number of mg of potassium hydroxide required to neutralize 1 g of the interpolymerizable acid. Preferred interpolymerizable acids are the low molecular weight acidic acrylic precursors, β-carboxyethyl acrylate and 2-(acryloyloxy)ethyl maleate.

Typical hydroxyalkyl esters of acrylic or methacrylic acid that may be used to enhance electrical conductivity include 2-hydroxyethyl acrylate, 2-hydroxyethyl methacrylate, 2-hydroxypropyl acrylate, 2-hydroxypropyl methacrylate, 4-hydroxybutyl acrylate, and 4-hydroxybutyl methacrylate.

Typical cyanoalkyl esters of acrylic or methacrylic acid that may be used to enhance electrical conductivity include 2-cyanoethyl acrylate and 2-cyanoethyl methacrylate.

Additional Components

The conductive coating composition may comprise a photoinitiators to facilitate copolymerization of the polymerizable precursors. When the conductive layer is to be cured by irradiation with ultraviolet radiation, a free radical generating initiating system activatable by ultraviolet radiation may be present. Suitable photoinitiating systems have been described in "Photoinitiators for Free-Radical-Initiated Photoimaging Systems," by B. M. Monroe and G. C. Weed, Chem. Rev., 93, 435–448 (1993) and in "Free Radical Polymerization" by K. K. Dietliker, in Chemistry and Technology of UV and EB Formulation for Coatings, Inks, and Paints, P. K. T. Oldring, ed, SITA Technology Ltd., London, 1991, Vol. 3, pp. 59–525.

Preferred free radical photoinitiating compounds include benzophenone; 2-hydroxy-2-methyl-1-phenylpropan-1-one (Darocur® 1173); 2,4,6-trimethylbenzolyl-diphenylphosphine oxide (Lucerin® TPO); 2,2-dimethoxy-2-phenyl-acetophenone (benzildimethyl ketal, BDK, Irgacure® 651, Lucerin® BDK); 2-methyl-1-[4-(methylthio) phenyl]-2-morpholinopropanone-1 (Irgacure® 907); 1-hydroxycyclohexylphenyl ketone (HCPK, Irgacure® 184); bis(2,6-dimethoxybenzolyl)-2,4,4-trimethylpentylphosphine oxide; and combinations thereof. Mixed photoinitiators include a 50:50 blend of 2-hydroxy-2-methyl-1-phenylpropan-1-one and 2,4,6-trimethylbenzolyl-diphenylphosphine oxide (Darocur® 4265); and a 25:75 blend of bis(2,6-dimethoxybenzolyl)-2,4,4-trimethylpentyl-phosphine oxide and 2-hydroxy-2-methyl-1-phenylpropan-1-one (CGI 1700).

In one embodiment, the conductive coating composition comprises one or more pigments to provide rigidity and structure to conductive layer 14. Amorphous silica, surface treated to disperse in the conductive coating composition, is preferred. It is commercially available in a variety of particle sizes and, because it does not absorb ultraviolet radiation, does not interfere with curing when the conductive coating composition is cured by exposure to ultraviolet radiation.

The distance of penetration of coating composition into a porous material is dependent its viscosity and surface tension, as given by the Lucas-Washburn equation:

$$L=[(R_c\gamma\cos\Theta\cdot t)/2\eta]^{1/2}$$

where:

L=the distance of penetration of the liquid;

$R_c$=the pore diameter;

$\gamma$=the surface energy of the porous material;

$\Theta$=the contact angle between the liquid and the porous material in the presence of are saturated with the liquid;

$\eta$=the viscosity of the liquid; and t=the time.

Penetration of the pores by the coating composition closes the pores in the porous base, increasing solvent holdout and enhancing the appearance of the surface of the conductive layer. Thus, the surface tension and viscosity of the conductive coating composition must be appropriately modified to match the coating process as well as penetration of porous base.

A small amount of a volatile solvent or a mixture of volatile solvents may be added to control the viscosity and/or surface tension of the conductive coating composition, to make dispersions or solutions of immiscible reactants, to raise the wet coat weight to match the capabilities of the coating process, and/or to control the adhesion of the conductive layer to the base. The conductive coating composition may comprise up to 15% by weight volatile solvent or solvents.

The added solvent should be readily removable from the coated layer of conductive coating composition after coating. Thus, solvents with a boiling point less than 110° C., preferably less than 100° C., should be used. Typical volatile solvents include the lower ketones and alcohols, such as, acetone, butanone, methanol, ethanol, 1-propanol, and 2-propanol.

Composition of the Conductive Coating Composition

The particular choice of ethylenically unsaturated ammonium precursors, other polymerizable precursors, and other additives in the conductive coating composition will be determined by the properties of the porous base, by the specific combination of properties desired in the conductive layer, i.e., conductivity, flexibility, cure rate, and need to overcoat with a dielectric layer, and by the properties of the conductive coating composition required for coating, i.e. viscosity and surface tension.

The conductive coating composition comprises 10 to 90 parts by weight of one or more ethylenically unsaturated ammonium precursors and 10 to 90 parts by weight of one or more other polymerizable precursors, based on the total weight of these components present in the conductive coating composition, and excluding the weight of the photoinitiator system and the weight of any other materials present in the conductive coating composition.

In the absence of a conductivity exalting monomer, higher levels of ethylenically unsaturated ammonium precursors are preferred. In this instance, the conductive coating composition comprises preferably 50 to 90 parts by weight ethylenically unsaturated ammonium precursors and more preferably 70 to 90 parts by weight ethylenically unsaturated ammonium precursors. When a photoinitiator is present, the ethylenically unsaturated ammonium precursors and other polymerizable precursors together comprise at least 80 percent by weight, and preferably at least 90 percent by weight, of the total solids. When neither a photoinitiator nor a pigment is present, the ethylenically unsaturated ammonium precursors and other polymerizable precursors together comprise at least 90 percent by weight, and preferably about 100 percent by weight, of the total solids present in conductive coating composition.

When a conductivity exalting monomer is used, a lower level of ethylenically unsaturated ammonium precursors can be used. In this instance, conductivity exalting comonomers and ethylenically unsaturated ammonium precursors together comprise 40 to 100 parts by weight, preferably 45 to 90 parts by weight, of the total weight of the ethylenically unsaturated ammonium precursor and other polymerizable precursors present in the conductive coating composition. The ratio of the conductivity exalting comonomer or comonomers to ethylenically unsaturated ammonium precursor is in the range of 0.25 to 2.0. This means that the comonomer is between about 20 parts by weight to 67 parts by weight of the total of comonomer and ammonium precursor, and the ethylenically unsaturated ammonium precursor is between 33 parts by weight and 80 parts by weight of the total of comonomer and ammonium precursor. Preferably, the ratio is in the range of 0.33 to 1.5. This means that, preferably, the comonomer is between about 25 parts by weight to 60 parts by weight of the total of comonomer and ammonium precursor, and the ethylenically unsaturated ammonium precursor is between 40 parts by weight and 75 parts by weight of the total of comonomer and ammonium precursor.

Other polymerizable precursors exclusive of the conductivity exalting comonomers make up the rest of the polymerizable materials present in the conductive coating composition. Typically, most or all of the remaining other polymerizable precursors are multi-functional polymerizable precursors. These precursors are typically greater that 55 parts by weight, and preferably greater than 85 parts by weight, of the other polymerizable precursors exclusive of the conductivity exalting comonomer.

When the conductive coating composition is to be cured by irradiation with ultraviolet radiation, it typically contains about 1 to 10 parts by weight, more typically about 3 to 8 parts by weight, of a photoinitiator, based on the total solids in the composition. When the conductive coating composition is to be cured by irradiation with an electron beam, a photoinitiator is not required. When one or more pigments are present, they typically comprise up to 6 to 8 parts by weight of the total solids in the composition.

BASE

Base 12 functions as a support for conductive layer 14, dielectric layer 16, and the image. It may be any porous web or sheet material possessing suitable flexibility, dimensional stability and adherence properties to conductive layer 14. Porous materials, such as, for example, paper, fabrics, and non-woven materials, such as Tyvek® spun-bonded polyolefin sheet, may be used as the base. The base may be translucent or opaque. Paper may be calendered to enhance its smoothness. Either conductive or non-conductive papers can be used. The weight of the paper, may vary over a wide range, for example 40–170 g/m$^2$.

For certain applications, it may be desirable to provide direct electrical contact to the conductive layer by coating the back side of base 12 (i.e., the side opposite that on which conductive layer 14 and dielectric layer 16 are coated) with a conductive coating to form backside conductive layer 18. Backside conductive layer 18 may comprises a film-forming material which may be an organic material, e.g., such as a cation type styrene-methacrylate copolymer having an electrical resistivity of about 1–30×10$^6$ ohm/□. Other suitable film-forming, organic materials include, for example, polymeric quaternary ammonium compounds; salts of polystyrene sulfonic acid, such as sodium polystyrene sulfonate; and polymeric matrices capable of ionizing inorganic electrolytes contained therein. The film-forming, organic material may be used alone or with conductive, inorganic materials and/or metals, such as tin oxide and aluminum, dispersed therein. Back coating is conveniently done either before or after the conductive layer and dielectric layer have been applied.

The conductive coating composition may be used to coat the back side of base 12 to form backside conductive layer 18 because it can be readily coated and cured without the need to remove large amounts of volatile solvents. If an electron beam is used to cure the conductive coating composition, both the conductive coating composition and the backside conductive layer can be simultaneously cured in a single curing step.

DIELECTRIC LAYER

Dielectric layer 16 determines the electrostatic charge accepted by the element and the time during which it will hold the charge. In addition, it must have sufficient dielectric strength to support the charging current without breakdown. The property requirements of the dielectric layer are well known in the art as disclosed, for example, in Akiyama, U.S. Pat. No. 3,920,880, and Coney, U.S. Pat. No. 4,201,701.

Dielectric layer 16 may be any conventional film-forming material having a dielectric constant of about 2 to about 5. Typically, a highly resistive polymer is used, such as homopolymers and copolymers of the following monomers: vinyl acetate; vinyl chloride; vinylidene chloride; vinyl butyral; acrylate monomers, such as methyl acrylate and ethyl acrylate; methacrylate monomers, such as methyl methacrylate, ethyl methacrylate, and butyl methacrylate; acrylonitrile; ethylene; styrene; and butadiene. The layer typically has a thickness of about 1 μm to about 20 μm and preferably about 3 μm to about 10 μm.

The dielectric layer contains a matte agent or pigment to provide the spacing and abrasion necessary for the imaging process. In the electrographic elements of this invention, the surface roughness of the dielectric layer does not depend on the roughness of the base. Because the surface of the conductive layer is relatively smooth, the surface roughness of the dielectric layer is primarily determined by the amount and type of matte agent or pigment added to the dielectric layer. The pigment may also serve to increase opacity, improve texture, reduce gloss, and increase the dielectric constant of the dielectric layer. The pigment may be, for example, clay, titanium dioxide, calcium carbonate, or silica. A dispersant for the pigment may also be required. The pigment may comprise from 10 percent by weight to 75 percent by weight, preferably about 50 percent by weight, of the dielectric layer on a dry weight basis.

The dielectric layer may be coated either from an aqueous or from a non-aqueous solvent. Coating of a dielectric layer from an aqueous solvent is disclosed in, for example, Work, U.S. Pat. No. 5,192,613. When the dielectric layer is coated from an aqueous solvent, solvent holdout to an aqueous solvent is required. The principles described above apply to solvent holdout by both aqueous and non-aqueous solvents.

If a self-releasing dielectric layer is used, it may be possible to transfer the image from the dielectric layer to a receptor. Self-releasing dielectric layers may comprise either a self-releasing dielectric polymer or a mixture of a dielectric polymer and a release material. Pigments and/or matte agents may also be included. Self-releasing dielectric layers are disclosed in Chou, U.S. Pat. No. 5,262,259, and Clemens, U.S. Pat. No. 4,728,571, each of which is incorporated by reference. The self-releasing dielectric layer should have a surface energy of between 14 erg/cm$^2$ and 20 erg/cm$^2$.

Self-releasing dielectric polymers include copolymers of methyl methacrylate with poly(dimethylsiloxane); and terpolymers of methyl methacrylate, poly(styrene), and poly (dimethylsiloxane). These polymers contain 10 to 30 percent by weight, preferably 10 to 20 percent by weight, of poly (dimethylsiloxane). Silicone-urea block copolymers that contain between 1 to 10 percent by weight of poly (dimethylsiloxane) can also be used as self-releasing dielectric polymers. Other self-releasing dielectric polymers may be obtained using polymerizable precursors capable of forming condensation products with silicone units through their amine or hydroxy termination groups, such as urethane, epoxy, and acrylic polymers in combination with silicone polymers, such as poly(dimethylsiloxane).

Polymer mixtures that can be used in self-releasing dielectric layers include mixtures that contain (1) at least one dielectric polymer, such as poly(styrene), poly(methyl methacrylate), poly(vinyl butyral), or a styrene/methyl methacrylate copolymer, and (2) at least one silicone-urea block copolymer. The block copolymer may contain 10 to 50 percent by weight poly(dimethylsiloxane). The ratio of dielectric polymer (1) to silicone-urea block copolymer (2) should be from 90:10 to 25:75. Poly(dimethylsiloxane) may be used in place of the silicone-urea block copolymer.

ELEMENT PREPARATION

Conductive layer 14 is prepared by coating the conductive coating composition onto base 12 and, following coating, curing the layer either with ultraviolet or with electron beam radiation. The conductive coating composition is coated as a solution or a dispersion. When the composition is coated as a dispersion, the coated dispersion typically is hazy. The coated dispersion, upon curing, typically forms a transparent, continuous, defect-free layer. The composition can be coated by a variety of well-known techniques, such as: manual coating and full scale production machine coating, including coating with wire wound or smooth (#0) Mayer rods; direct gravure or offset gravure, which are especially useful for depositing very low coating weight in the order of 0.2 to 5 g/m$^2$; and roll, slot, spray, dip and curtain coating and the like.

The conductive coating composition must be of the appropriate viscosity for coating. Although the viscosity of the conductive coating composition may be varied widely depending on the coating method, typically coating viscosity is from about 100 to about 2000 cps. at 25° C. As is well known to those skilled in the art, viscosity can be altered by the addition of appropriate volatile solvents, polymerizable precursors, pigments, and/or other additives required to match the needs of the coating process with the desired properties of the conductive layer, such as coating weight, penetration of the base, and coverage. At lower viscosities, greater penetration and less coverage is typically observed; at higher viscosities, higher coverage and less penetration is observed.

Cure refers to polymerization and/or crosslinking of the ethylenically unsaturated precursors by free-radical initiated addition polymerization. Cure is accomplished by exposing a conductive coating composition containing a photoinitiator to intense ultraviolet light sources such as those available from AETEK International (Plainfield, Ill.) or Fusion U.V. Curing Systems, Inc. (Rockville, Md.). Exposure may be carried out either in sheet form, as in the AETEK laboratory units, or in continuous web form, as on production scale coating machines having an ultraviolet curing station following the coating head. Alternatively, the conductive coating composition can be cured by exposure to an electron beam. As is well known to those skilled in the art, the curing conditions depend upon a number of factors such as: the nature and amount of ethylenically unsaturated ammonium precursor present, the nature and amount of other polymerizable components present, the nature and amount of photoinitiator present, coating thickness, line speed, lamp or beam intensity, and the presence or absence of an inert atmosphere.

After conductive layer 14 has been cured, it is overcoated with dielectric layer 16. It is extremely important that a smooth, continuous, uniform, flaw-free coating be obtained. Dielectric layer 16 is typically coated from a volatile solvent, and the solvent removed by heating after coating. Any of the commonly used coating techniques, such as those described above, may be used to coat dielectric layer 16.

IMAGE FORMATION

The image is produced by forming a latent image of charge on dielectric layer 16 and toning the latent image. When a multi-colored image is desired, the imaging and toning sequence is repeated with additional toners of different colors, either in sequentially arranged imaging and toning stations or by passing the element under the same imaging station and replacing the toner in the toning station.

Typically, the printer comprises: a stylus or electrostatic imaging bar that produces an electrostatic latent image on dielectric layer 16; a liquid toner developing device that includes an application system to deposit liquid toner on the electrostatic latent image; and a drying system to remove the solvent from the liquid toner. Printers include those available from, for example, Xerox ColorgrafX Systems (San Jose, Calif.), 3M Commercial Graphics (St. Paul, Minn.), and Raster Graphics, Inc. (San Jose, Calif.).

Color reproduction usually requires at least three color toners, typically yellow, magenta, and cyan, and preferably four different color toners, yellow, magenta, cyan, and black, to render a pleasing and accurate facsimile of an original color image. Typically, the toners are applied in the order: black, cyan, magenta, and yellow. Additional colors may be added, if desired. The selection of toner colors and the creation of the different images whose combination will provide an accurate rendition of an original image is well known in the art. Toners are available from, for example, Xerox ColorgrafX Systems (San Jose, Calif.), 3M Commercial Graphics (St. Paul, Minn.), Raster Graphics, Inc. (San Jose, Calif.), and Specialty Toner Corp. (Fairfield, N.J.).

If a self-releasing dielectric layer is used, the toner particles comprising the image may be transferred to a receptor instead of being fixed to the surface of the dielectric coating. Image transfer, and the preparation of toners suitable for use in image transfer, is disclosed in Chou, U.S. Pat. No. 5,262,259, incorporated herein by reference. The image is transferred to the receptor by bringing the receptor in contact with the surface of the dielectric layer, preferably in a vacuum frame. The image is transferred under heat and pressure, typically at a gauge pressure of about 1 atmosphere (about $1\times10^6$ dynes/cm$^2$) and a temperature of about 110° C.

The receptor is typically a coated sheet material. Poly (vinyl chloride), acrylics, poly(urethane)s, poly(ethylene/acrylic acid copolymers, and poly(vinyl butyral) may be used as the sheet material. Polymers that may be used in the surface coating include acrylate polymers and copolymers, such as polymers and copolymers of methyl methacrylate (except for high molecular weight poly(methyl methacrylate)), ethyl methacrylate, butyl methacrylate, and isobutyl methacrylate with each other and with other methacrylates and/or acrylates; low molecular weight vinyl acetate/vinyl chloride copolymers; and aliphatic polyesters. A useful commercially available receptor is ScotchCal® pressure sensitive vinyl (3M Commercial Graphics, St. Paul, Minn.).

INDUSTRIAL APPLICABILITY

Electrographic imaging requires low energy levels, no impact, and no chemical processing. Images formed on electrographic imaging elements of this invention have higher image density, reduced background, reduced grain, reduced mottle, reduced overtoning, and greater small-scale uniformity than comparable images formed on electrographic imaging elements produced by other methods. The elements can be processed at higher speeds by printers using high solids liquid toners, increasing the productivity of the printer and reducing the time required to form an image.

The elements of this invention are useful for the production of images, especially colored images. Electrographic imaging is particularly useful for forming large size images, such as are required for posters, displays, other indoor advertising.

The advantageous properties of this invention can be observed by reference to the following examples which illustrate, but do not limit, the invention.

EXAMPLES

"Conductive coating composition" refers to the mixture of materials coated onto the base to produce the conductive layer. "Total solids" refers to the total amount of non-volatile material in the conductive coating composition, even though some of these materials may be non-volatile liquids before cure.

Glossary

| | |
|---|---|
| Ageflex ® FA1Q80MC | 80% 2-Acryloyloxyethyltrimethylammonium chloride in water (CPS Chemical, Old Bridge, NJ) |
| β-CEA | Carboxyethyl acrylate |
| Chemistat ® 6300H | 33% Styrene/methacrylate quaternary ammonium electroconductive copolymer in aqueous solution (Sanyo Chemical Industries, Kyoto, Japan) |
| Darocur ® 1173 | 2-Hydroxy-2-methyl-1-phenylpropan-1-one (Ciba Geigy, Hawthorne, NY) |
| DMDAC | 60% Dimethyldiallylammonium chloride in water (Aldrich, Milwaukee, WI) |

-continued

| | |
|---|---|
| Ebecryl ® 11 | Water dilutable polyether acrylate (U.C.B. Radcure Inc., Smyrna, GA) |
| Ebecryl ® 350 | Polyacrylated poly(dimethylsiloxane)-polyether copolymer having a viscosity of 200–300 cp at 25° C. (U.C.B. Radcure Inc., Smyrna, GA) |
| Ebecryl ® 1360 | Hexaacrylate of a poly(dimethylsiloxane)-polyether copolymer having a viscosity of 1000–3000 centipoise at 25° C. (U.C.B. Radcure Inc., Smyrna, GA) |
| Ebecryl ® 1608 | Bisphenol A epoxy acrylate & 20 percent propoxylated glycerol triacrylate (U.C.B. Radcure Inc., Smyrna, GA) |
| Photomer ® 5018 | Tetrafunctional polyester acrylate (Henkel Corp., Ambler, PA) |
| Silcron ® G603 | Amorphous silica, dry powder, particle size about 11 microns (CSM Chemical, Baltimore, MD) |
| TMPEOTA | Trimethylolpropane ethoxy acrylate (U.C.B. Radcure Inc., Smyrna, GA) |

General Procedures

Electrical conductivity of the base is characterized by surface resistivity and/or by volume resistance. Surface resistivity is expressed in ohms per square (Ω/□). Volume resistance is expressed in ohms (Ω). Unless otherwise indicated, surface resistivity was measured at 100 volts under TAPPI conditions, 73° F. (about 23° C.) and 50% relative humidity, with a Monroe Model 272A resistivity meter (Monroe Electronics, Lyndonville, N.Y.). Viscosities were measured with a Brookfield viscometer. Solvent holdout was measured with a Hercules Sizing Tester using Malachite Green in 2:1 tolueneacetone. Unless otherwise indicated, solvent holdout was measured for the coated side of the element, that is, the side of the base which contains the conductive layer. Sheffield surface roughness (expressed in mL/min) was measured with a Smoothcheck apparatus (Giddiness & Luis). Image density and image background (delta E) were measured with X-Rite 938 spectrodensitometer (X-Rite, Inc., Grandville, Mich.). Image uniformity was measured with an image analysis system.

Comparative Example

This example illustrates formation of an electrographic imaging element by a method in which the conductive coating composition contained about 4% total solids.

A conductive coating composition was prepared from the following ingredients:

| Ingredient | Parts by Weight |
|---|---|
| Ethanol | 70.00 |
| Acetone | 18.00 |
| Chemistat ® 6300H | 12.00 |

The base was Chartham OCB-08 90 g paper (Chartham Paper Mill, Canterbury, Kent, UK). The conductive coating composition was coated onto the front side of the base at a line speed of 500 ft/min (about 250 cm/sec) by rod coating at a wet coating weight of 15.6 g/m$^2$.

A conventional dielectric coating mixture was prepared. The coating mixture contained about 15 weight percent of a mixture of poly(vinyl butyral) and an acrylic polymer and about 13 weight percent of a mixture of calcium carbonate, titanium dioxide, and poly(styrene) pigments in a mixture of organic solvents. The dielectric coating mixture was applied to the upper surface of the base by reverse roll coating and dried to give an electrographic imaging element. The dry coating weight of the dielectric layer was 5.8 g/m$^2$.

The back side of the base was coated by the same procedure to form a backside conductive layer. The backside coating composition contained 57.0 parts by weight ethanol, 19.0 parts by weight water, and 24.0 parts by weight Chemistat® 6300H. Wet coating weight was 15.6 g/m$^2$.

A four-color toned image was formed on the dielectric layer of the element using a Xerox 8954 color electrostatic printer (Xerox ColorgrafX Systems, San Jose, Calif.) and HiBrite® toners (Xerox ColorgrafX Systems, San Jose, Calif.) at 50% image contrast. Image evaluation is given in Table 1.

Example 1

This example illustrates formation of an electrographic imaging element by using a method in which the coating composition contains 86% total solids. No volatile solvent was added.

A conductive coating composition was prepared from the following ingredients:

| Ingredient | Parts by Weight |
|---|---|
| Ageflex ® FA1Q80MC | 70.0 |
| Ebecryl ® 1608 | 26.0 |
| Darocur ® 1173 | 4.0 |

The conductive coating composition had a Brookfield viscosity of 400 cp.

Base 12 was Chartham OCB-08 90 g paper. The conductive coating composition was coated onto the front side of base 12 at a line speed of 220 ft/min (about 110 cm/sec) by reverse gravure at a coating weight of 4.0 g/m$^2$. A roll speed ratio of 1.2 produced good, uniform coverage. Following coating the coated base was cured by exposure to a 300 watts/in (about 120 watts/cm) ultraviolet source in the presence of an inerting gas to produce an intermediate element consisting of base 12 and conductive layer 14.

The dielectric coating composition was coated onto conductive layer 14 as described in the Comparative Example. The back side of base 12 was coated to form backside conductive layer 18 as described in the Comparative Example. Electrographic imaging element 10 consisting of base 12, conductive layer 14, dielectric layer 16, and backside conductive layer 18 was formed.

A four-color toned image was formed on dielectric layer 16 of element 10 as described in the Comparative Example. Image evaluation is given in Table 1.

TABLE 1

| | Comparative Example | Example 1 |
|---|---|---|
| Image Density: | | |
| Black | 1.47 | 1.49 |
| Cyan | 1.42 | 1.46 |
| Magenta | 1.34 | 1.36 |
| Yellow | 0.93 | 0.95 |
| Image Background (delta E) | 2.40 | 1.70 |
| Image Uniformity[a] | 46.4 | 27.4 |

[a]Measured on green from a separate set of images.

The image formed in Example 1 had less image mottle and grain than the image formed in the Comparative Example. The image formed in Example 1 also had less overtoning (better color fidelity) than the image formed in the Comparative Example.

Example 2

This example illustrates the use of a non-conductive paper for the preparation of an electrographic recording element. The conductive coating composition contained about 83% total solids. No volatile solvent was added.

A conductive coating composition was prepared from the following ingredients.

| Component | Amount (parts by weight) |
|---|---|
| Ageflex ® FA1Q80MC | 85.0 |
| Ebecryl ® 1608 | 11.0 |
| Darocur ® 1173 | 4.0 |

The coating composition was coated onto UVI base paper (a non-conductive paper) (Otis Specialty Papers, Jay, Me.) by reverse gravure coating to give a coating weight of 2.9 $g/m^2$. The coating was cured by exposure to two banks of 300 watts/in (about 120 watts/cm) ultraviolet lamps at a line speed of 40 ft/min (about 20 cm/sec) to produce an intermediate element consisting of base 12 and conductive layer 14. The element had a surface resistivity of $1.6\times10^6$ Ω/□ and had a volume resistance of $4.2\times10^6$ Ω. The uncoated base had a surface resistivity of $6.6\times10^{10}$ Ω/□ and a volume resistance of $1.0\times10^8$ Ω.

Dielectric layer 16, described in the Comparative Example, was coated onto conductive layer 14 by rod coating and dried to give a dry coating weight of 7.8 $g/m^2$. Electrographic imaging element 10 consisting of base 12, conductive layer 14, and dielectric layer 16 was formed.

Imaging with a Versatec® V-80F Electrostatic Printer (Xerox Engineering Systems, Rochester, N.Y.) using a standard toner and standard operating conditions gave an image with good image density.

Example 3

This example illustrates use of an electrographic coating composition containing dimethyldiallylammonium chloride, a non-acrylic quaternary ammonium monomer, and β-CEA, a conductivity enhancing co-monomer. The conductive coating composition contained about 92% total solids. No volatile solvent was added.

The following conductive coating composition was prepared and coated onto Otis dielectric recording paper (Otis Specialty Papers, Jay, Me.) with a #0 Mayer rod.

| Component | Amount (g) |
|---|---|
| DMDAC | 10.7 |
| β-CEA | 10.0 |
| Ebecryl ® 11 | 10.0 |
| Photomer ® 5018 | 10.0 |
| Ebecryl ® 1608 | 11.5 |
| Darocur ® 1173 | 2.0 |

The coating was cured by two passes under two 400 watts/in (about 160 watts/cm) mercury vapor lamps at 200 ft/min (about 100 cm/sec). The surface resistivity of the cured coating was $1.1\times10^6$ Ω/□ at 62% relative humidity and 73° F. (23° C.).

Coating a dielectric layer, such as that described in the Comparative Example, over conductive layer 14 forms an electrographic imaging element 10 consisting of base 12, conductive layer 14, and dielectric layer 16. Imaging is carried out using standard equipment and conditions, such as is described in the Comparative Example or in Example 2.

Example 4

This example illustrates curing of a photoinitiator-free conductive coating composition by electron beam irradiation. The conductive coating composition contained about 93% total solids. The composition contained β-CEA, a conductivity enhancing monomer. No volatile solvent was added.

The following conductive coating composition was prepared and coated onto a base of Otis Specialty DR conductive paper with a smooth Mayer rod.

| Component | Amount (g) |
|---|---|
| Ageflex ® FA1Q80MC | 264 |
| β-CEA | 160 |
| TMPEOTA | 160 |
| Ebecryl ® 1608 | 176 |
| Ebecryl ® 350 | 8 |
| Ebecryl ® 1360 | 8 |

The coating was cured to a dry glossy coating with 0.5 megarad of irradiation at the pilot unit at Energy Sciences, Inc., Wilmington, Mass., to form an element consisting of base 12 and conductive layer 14. Surface resistivity of the element was $6–8\times10^5$ Ω/□. The surface resistivity of the uncoated paper was $2.5\times10^6$ Ω/□.

Coating a dielectric layer, such as that described in the Comparative Example, over conductive layer 14 forms an electrographic imaging element 10 consisting of base 12, conductive layer 14, and dielectric layer 16. Imaging is carried out using standard equipment and conditions, such as is described in the Comparative Example or in Example 2.

Example 5

This example illustrates the properties of elements formed by the method of this invention.

The following conductive coating compositions were prepared. Composition #1 contains about 85% total solids. Composition #2 contains about 83% total solids.

| Ingredient | Composition #1 Parts by Weight | Composition #2 Parts by Weight |
|---|---|---|
| Ageflex ® FA1Q80MC | 75 | 85 |
| Ebecryl ® 1608 | 21 | 11 |
| Darocur ® 1173 | 4 | 4 |

The viscosity of Composition #1 was 350 cp. The viscosity of Composition #2 was 150 cp.

Each coating composition was coated onto a base of Chartham OCB-08 90 g paper by gravure coating. Each coating was cured by exposure to two 300 watts/in (about 120 watts/cm) ultraviolet lamps at a line 35–40 ft/min (about 17–20 cm/sec) to form an element consisting of base 12 and conductive layer 14. The surface resistivity of base 12 and of each conductive layer 14 was measured is in Table 2.

TABLE 2

| SURFACE RESISTIVITY | |
|---|---|
| Base[a] | $2.6 \times 10^7$ Ω/□ |
| Comparative Example | $1.0 \times 10^7$ Ω/□ |
| Composition #1[b] | $4.2 \times 10^6$ Ω/□ |
| Composition #1[c] | $4.6 \times 10^6$ Ω/□ |
| Composition #2[d] | $2.1 \times 10^6$ Ω/□ |

[a]Chartham OCB-08 90 g paper.
[b]Coating weight of 4.3 g/m$^2$.
[c]Coating weight of 4.0 g/m$^2$.
[d]Coating weight of 3.5 g/m$^2$.

Solvent holdout for the uncoated base 12 was 10.6 sec. Solvent holdout was measured for the intermediate element formed in the Comparative Example and for each of the intermediate elements formed by coating the base with Composition #1 and with Composition #2. In each case solvent holdout was greater than 100 sec.

The dielectric coating composition described in the Comparative Example was coated on top of each conductive layer 14 using a #16 Mayer rod at a line speed of 25 ft/min (about 12 cm/sec) and a drying temperature of 230° F. (110° C.).

The surface roughness of Chartham OCB-08 90 g paper was measured with and without the dielectric coating. The surface roughness of the element formed in the Comparative Example was measured with and without the dielectric coating. The surface roughness of each of the elements formed by coating the base with Composition #1 and composition #2 was measured with and without the dielectric coating. The results are given in Table 3.

TABLE 3

| SURFACE ROUGHNESS[a] | | |
|---|---|---|
| | No Dielectric Coating | With Dielectric Coating |
| Base[b] | 25 | 105 |
| Comparative Example | 37 | 125 |
| Composition #1[c] | 20 | 100 |
| Composition #1[d] | 20 | 100 |
| Composition #2[e] | 20 | 95 |

[a]Expressed in mL/min.
[b]Chartham OCB-08 90 g paper.
[c]Coating weight of 4.3 g/m$^2$.
[d]Coating weight of 4.0 g/m$^2$.
[e]Coating weight of 4.3 g/m$^2$.

Black and white prints were prepared with a Versatec® V-80F Printer. The electrographic recording elements prepared from Compositions #1 and #2 had better image density than that prepared in the Comparative Example.

Example 6

The procedure of Example 5 was repeated with Otis Specialty UVI base paper (a non-conductive paper) except that the composition from the Comparative Example was not evaluated on this paper. Results are given in Tables 4 and 5.

TABLE 4

| SURFACE RESISTIVITY | |
|---|---|
| Base[a] | $6.6 \times 10^{10}$ Ω/□ |
| Composition #1[b] | $1.6 \times 10^6$ Ω/□ |

TABLE 4-continued

| SURFACE RESISTIVITY | |
|---|---|
| Composition #1[c] | $2.4 \times 10^6$ Ω/□ |
| Composition #2[d] | $2.0 \times 10^6$ Ω/□ |

[a]UVI paper.
[b]Coating weight of 4.3 g/m$^2$.
[c]Coating weight of 4.0 g/m$^2$.
[d]Coating weight of 3.5 g/m$^2$.

Solvent holdout for the uncoated base was 12.0 sec. Solvent holdout for each of the elements formed by coating the base with Composition #1 and Composition #2 was greater than 100 sec.

TABLE 5

| SURFACE ROUGHNESS | | |
|---|---|---|
| | No Dielectric Coating | With Dielectric Coating |
| Base[a] | 40 | 110 |
| Composition #1[b] | 15 | 85 |
| Composition #1[c] | 15 | 90 |
| Composition #2[d] | 15 | 95 |

[a]UVI paper.
[b]Coating weight of 4.3 g/m$^2$.
[c]Coating weight of 4.0 g/m$^2$.
[d]Coating weight of 3.5 g/m$^2$.

Example 7

The procedure of Example 5 was repeated with Otis reprobond paper (Otis Specialty Papers, Jay, Me.) except that the composition from the Comparative Example was not evaluated on this paper. Results are given in Tables 6 and 7.

TABLE 6

| SURFACE RESISTIVITY | |
|---|---|
| Base[a] | $3.3 \times 10^7$ Ω/□ |
| Composition #1[b] | $1.3 \times 10^6$ Ω/□ |
| Composition #1[c] | $2.4 \times 10^6$ Ω/□ |
| Composition #2[d] | $1.4 \times 10^6$ Ω/□ |

[a]Otis reprobond paper
[b]Coating weight of 4.3 g/m$^2$.
[c]Coating weight of 4.0 g/m$^2$.
[d]Coating weight of 3.5 g/m$^2$.

Solvent holdout for the uncoated base was 0.8 sec. Solvent holdout for each of the elements formed by coating the base with Composition #1 and Composition #2 was greater than 100 sec.

TABLE 7

| SURFACE ROUGHNESS | | |
|---|---|---|
| | No Dielectric Coating | With Dielectric Coating |
| Base[a] | 65 | 135 |
| Composition #1[b] | 22 | 90 |
| Composition #1[c] | 28 | 100 |
| Composition #2[d] | 30 | 105 |

[a]Otis reprobond paper
[b]Coating weight of 4.3 g/m$^2$.

TABLE 7-continued

| SURFACE ROUGHNESS | No Dielectric Coating | With Dielectric Coating |
|---|---|---|

[c]Coating weight of 4.0 g/m$^2$.
[d]Coating weight of 3.5 g/m$^2$.

Example 8

The procedure of Example 5 was repeated with an experimental high resistivity 70 g/m$^2$ paper from Chartham Paper Mill, Canterbury, Kent, UK, except that the composition from the Comparative Example was not evaluated on this paper. Results are given in Tables 8 and 9.

TABLE 8

| SURFACE RESISTIVITY | |
|---|---|
| Base[a] | $1.8 \times 10^8$ Ω/□ |
| Composition #1[b] | $2.1 \times 10^6$ Ω/□ |
| Composition #1[c] | $5.3 \times 10^6$ Ω/□ |
| Composition #2[d] | $2.5 \times 10^6$ Ω/□ |

[a]Chartham experimental high resistivity paper.
[b]Coating weight of 4.3 g/m$^2$.
[c]Coating weight of 4.0 g/m$^2$.
[d]Coating weight of 3.5 g/m$^2$.

Solvent holdout for the uncoated base was 1.2 sec. Solvent holdout for each of the elements formed by coating the base with Composition #1 and Composition #2 was greater than 100 sec.

TABLE 9

| SURFACE ROUGHNESS | No Dielectric Coating | With Dielectric Coating |
|---|---|---|
| Base[a] | 30 | 110 |
| Composition #1[b] | 25 | 90 |
| Composition #1[c] | 20 | 100 |
| Composition #2[d] | 20 | 90 |

[a]Chartham experimental high resistivity paper.
[b]Coating weight of 4.3 g/m$^2$.
[c]Coating weight of 4.0 g/m$^2$.
[d]Coating weight of 3.5 g/m$^2$.

Example 9

This example illustrates the use of conductive coating composition that comprises a pigment. The conductive coating composition comprises about 87% total solids.

A conductive coating composition was prepared from the following ingredients:

| Ingredient | Parts by Weight |
|---|---|
| Ageflex ® FA1Q80MC | 63.0 |
| Ebecryl ® 1608 | 22.7 |
| Ebecryl ® 350 | 0.8 |
| Silcron ® G603 | 10.0 |
| Darocur ® 1173 | 3.5 |

The conductive coating composition was coated onto a base of Ultracon® coating base paper (Otis Specialty Papers, Jay, Me.), a partly conductive porous base paper with a medium level of smoothness and a low level of solvent holdout. Traditional electrographic imaging elements prepared with this base are characterized by grain and overtoning on a microscale.

The Brookfield viscosity of the coating composition was 3100 cps at about 22° C. (LV2 spindle). It was applied to the felt of the base paper by reverse gravure coating at a coat weight of 4.5 g/m$^2$ and cured by the method described in Example 1 to form an element consisting of base 12 and conductive layer 14. The surface resistivity of the element was $2.0 \times 10^6$ Ω/□.

The properties of the base paper and the conductive element are given in Table 10.

TABLE 10

| | Ultracon Paper | | Element | |
|---|---|---|---|---|
| | Felt Side | Wire Side | Felt Side[a] | Wire Side |
| Surface resistance ($\times 10^6$ Ω/□) | 100 | 100 | 3.8 | 9.5 |
| Volume resistance ($\times 10^6$ Ω) | 0.24 | 0.42 | 0.14 | 0.09 |
| Smoothness (mL/min) | 75 | 65 | 30 | 70 |
| Solvent holdout (sec) | 0.9 | 0.7 | 17 | 0.9 |

[a]Coated with the conductive coating composition.

The surface resistivity, Sheffield smoothness and solvent holdout of the felt side were all made much more suitable for high performance electrographic imaging by the conductive coating composition. The volume resistance was also improved.

Example 10

This example illustrates formation of an electrographic imaging element by using a method in which the coating composition comprises a volatile solvent to modify the fluid properties of the coating composition to match the coating process.

The procedure of Example 1 was repeated except that 15% by weight 2-propanol was added to the coating composition. The conductive coating composition comprises about 73% total solids. The conductive coating composition had a Brookfield viscosity of 400 cp. The coating composition was coated onto the front side of Otis Specialty DR conductive paper by reverse roll coating at a line speed of 300 ft/min (about 150 cm/sec) by reverse gravure at a coating weight of 4.0 g/m$^2$. A roll speed ratio of 1.0 produced good, uniform coverage. Following coating the coated base was cured by exposure to a 300 watts/in (about 120 watts/cm) ultraviolet source in the presence of an inerting gas to produce an element consisting of base 12 and conductive layer 14.

Having described the invention, we now claim the following and their equivalents.

What is claimed is:

1. A method for forming an electrographic imaging element, said element comprising, in order, a porous base, an electrically conductive layer, and a dielectric layer; said porous base and said electrically conductive layer each having a surface roughness, said electrically conductive layer having a surface resistivity, and said porous base having a solvent holdout; said method comprising, in order:

(A) forming said electrically conductive layer by:

(1) coating a conductive coating composition onto said porous base, said coating composition comprising:

(a) one or more ethylenically unsaturated ammonium precursors; and (b) one or more other polymerizable precursors; and (2) curing said conductive coating composition to form an intermediate element comprising said porous base and an electrically conductive layer, said intermediate element having a solvent holdout;

whereby:

the surface roughness of said electrically conductive layer is less than the surface roughness of said porous base;

the solvent holdout of said intermediate element is greater than the solvent holdout of said porous base; and said surface resistivity of said electrically conductive layer is $1\times10^5$ to $1\times10^8$ Ω/□; and (B) coating said dielectric layer onto said electrically conductive layer;

wherein:

said conductive coating composition comprises at least 50 percent total solids;

said conductive coating composition comprises 10 to 90 parts by weight of said one or more ethylenically unsaturated ammonium precursors and 10 to 90 parts by weight of said other polymerizable precursors, said parts by weight based on the total weight of said one or more ethylenically unsaturated ammonium precursors and said other polymerizable precursors present in said conductive coating composition; and said one or more ethylenically unsaturated ammonium precursors and said other polymerizable precursors together comprise at least 50 percent by weight of the total solids present in said conductive coating composition.

2. The method of claim 1 whereby the solvent holdout of said intermediate element is greater than the solvent holdout of said porous base by at least a factor of 5.

3. The method of claim 2 whereby the surface roughness of said electrically conductive layer is less than the surface roughness of said porous base by at least a factor of one third.

4. The method of claim 3 wherein said porous base is selected from the group consisting of paper, fabric, and non-woven materials.

5. The method of claim 3 wherein said conductive coating composition comprises 1 to 10 parts by weight, based on the total solids in said conductive coating composition, of a photoinitiator and wherein said curing is carried out by exposure of said conductive coating composition to ultraviolet radiation.

6. The method of claim 3 wherein said curing is carried out by exposure of said conductive coating composition to an electron beam.

7. The method of claim 3 wherein said conductive coating composition comprises up to 15 percent by weight of a solvent or a mixture of solvents, said solvent or solvents each having a boiling point less than 110° C.

8. The method of claim 3 wherein said conductive coating composition comprises at least 80 percent by weight total solids.

9. The method of claim 3 wherein said conductive coating composition comprises 40 to 100 parts by weight of:

(1) said ethylenically unsaturated ammonium precursor; and (2) a conductivity exalting comonomer, said comonomer selected from the group consisting of interpolymerizable acids with an acid number between 100 and 900, hydroxyalkyl esters of acrylic or methacrylic acid, cyanoalkyl esters of acrylic or methacrylic acid, and combinations thereof;

wherein the comonomer is between about 20 parts by weight to 67 parts by weight of the total of comonomer and ammonium precursor, and the ethylenically unsaturated ammonium precursor is between 33 parts by weight and 80 parts by weight of the total of comonomer and ammonium precursor.

10. The method of claim 3 wherein said dielectric layer is coated from a non-aqueous solvent.

11. The method of claim 3 wherein said dielectric layer is coated from an aqueous solvent.

12. The method of claim 3 whereby said conductive layer has a Sheffield surface roughness of less than 70 mL/min.

13. The method of claim 12 wherein said conductive coating composition comprises more than 70 percent total solids.

14. The method of claim 13 whereby said solvent holdout of said intermediate element is greater than 10 sec.

15. The method of claim 14 whereby said conductive layer has a Sheffield surface roughness of less than 40 mL/min.

16. The method of claim 14 wherein said ethylenically unsaturated ammonium precursors comprise more than 60 parts by weight of said coating composition, based on the total weight of said ethylenically unsaturated ammonium precursors and said other polymerizable precursors present in said coating composition.

17. The method of claim 16 whereby the solvent holdout of said intermediate element is greater than the solvent holdout of said porous base by at least a factor of 50.

18. The method of claim 17 whereby said conductive layer has a Sheffield surface roughness of less than about 40 mL/min.

19. The method of claim 12 wherein said conductive coating composition comprises more than 80 percent total solids.

20. The method of claim 3 additionally comprising the step of coating the back side of said porous base with a conductive coating to form a backside conductive layer.

21. The method of claim 20 wherein said backside conductive layer is a radiation curable composition.

22. The method of claim 21 wherein said backside conductive layer is coated before the curing of said conductive coating composition and said conductive coating composition and said backside conductive layer are cured by exposure to an electron beam.

* * * * *